United States Patent [19]

Doyle

[11] 4,133,533

[45] Jan. 9, 1979

[54] GAME DEVICE

[76] Inventor: Natividad F. Doyle, 6202 E. 150th St., Grandview, Mo. 64030

[21] Appl. No.: 822,046

[22] Filed: Aug. 5, 1977

[51] Int. Cl.[2] ..... A63B 67/18

[52] U.S. Cl. ..... 273/106 A

[58] Field of Search ..... 273/106 R, 106 A, 106 F, 273/106.5 R, 106.5 C; 15/229 R

[56] References Cited

U.S. PATENT DOCUMENTS

| | | | |
|---|---|---|---|
| 1,008,071 | 11/1911 | Rowell | 15/229 R |
| 1,427,627 | 8/1922 | Pendergast | 15/229 R |
| 1,462,794 | 7/1923 | Kumpunen | 15/229 R X |
| 1,633,584 | 6/1927 | Hertzberg | 15/229 R |
| 2,025,325 | 12/1935 | Bauer | 273/106 A |
| 2,640,699 | 6/1953 | Garbo | 273/106 B |
| 3,368,815 | 2/1968 | Alabastro | 273/106 F |
| 3,393,911 | 7/1968 | Lawson | 273/106 R |
| 3,759,518 | 9/1973 | Mroz | 273/106 B |
| 3,834,705 | 9/1974 | Wong | 273/106 A |
| 3,901,509 | 8/1975 | Liong | 273/106 A |

FOREIGN PATENT DOCUMENTS

| | | | |
|---|---|---|---|
| 24987 of | 1897 | United Kingdom | 273/106.5 R |
| 442040 | 1/1936 | United Kingdom | 273/106.5 R |

*Primary Examiner*—Paul E. Shapiro

*Attorney, Agent, or Firm*—Fishburn, Gold & Litman

[57] ABSTRACT

A game device in the nature of a shuttlecock, bird or the like, comprises a weighted base having one end thereof adapted for resilient impact with a shuttlecock projector, such as a paddle, a racket, or a portion of the user's body. An assemblage of lightweight filament is connected with the other end of the base and assumes a fan-shaped array which imparts a floating action to the flight of the game device for improved safety and enjoyment.

4 Claims, 4 Drawing Figures

GAME DEVICE

BACKGROUND OF THE INVENTION

This invention relates to game devices, and in particular to shuttlecocks or birds.

Game devices which include a projectile in the nature of a shuttlecock or bird are often provided with paddles or rackets to impart motion to the projectile, such as used in the games of battledore and badminton. These devices may also be used in conjunction with a net. Shuttlecocks are also used in games wherein the projectile is kicked about a playing area and/or into the air by the participants. Such games and devices are generally adapted for use out-of-doors or in a similarly spacious setting, such as a field house, gymnasium, or the like, due to the rather large area required to safely play these games, and are not adapted for use inside an average sized residential house. Furthermore, such shuttlecocks are designed to fly through the air at a relatively high rate of speed. Elongate, substantially rigid feathers are generally attached to one end of a weighted base portion of the device to guide the flight of the shuttlecock in a manner wherein the other end of the weighted base is oriented forwardlymost in the direction of flight. The feathers, which guide the shuttlecock's flight, do not sufficiently reduce or retard the speed of the shuttlecock to adapt it for use indoors, and are often damaged when the shuttlecock is kicked or batted by a portion of the user's body, and can also cause injury to the user.

The principal objects of the present invention are: to provide a game device in the nature of a shuttlecock having an assemblage of lightweight filament and being suitable for use in both indoors and outdoors; to provide such a device wherein the filament imparts a floating action to the flight of the shuttlecock through the air for greater safety and enjoyment; to provide such a device wherein the assemblage is constructed of a plurality of flexible and resilient strands to alleviate the chance of injury to the user and/or the shuttlecock during use; to provide such a device wherein a medial portion of each strand is connected with the other end of the weighted base for secure attachment; to provide such a device having an adjustable tip cushion for use both indoors and outdoors; to provide such a device having an annularly shaped weight and a fastener with an enlarged head and deformable legs for quickly and efficiently attaching the assemblage to the weight; to provide such a device having a soft, flexible sleeve constructed of a foam material and disposed over the weight for increased floating action, resilient impact with the shuttlecock projector, and improved safety; and to provide such a device which is economical to manufacture, efficient in use, capable of a long operating life, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

Figure 1:
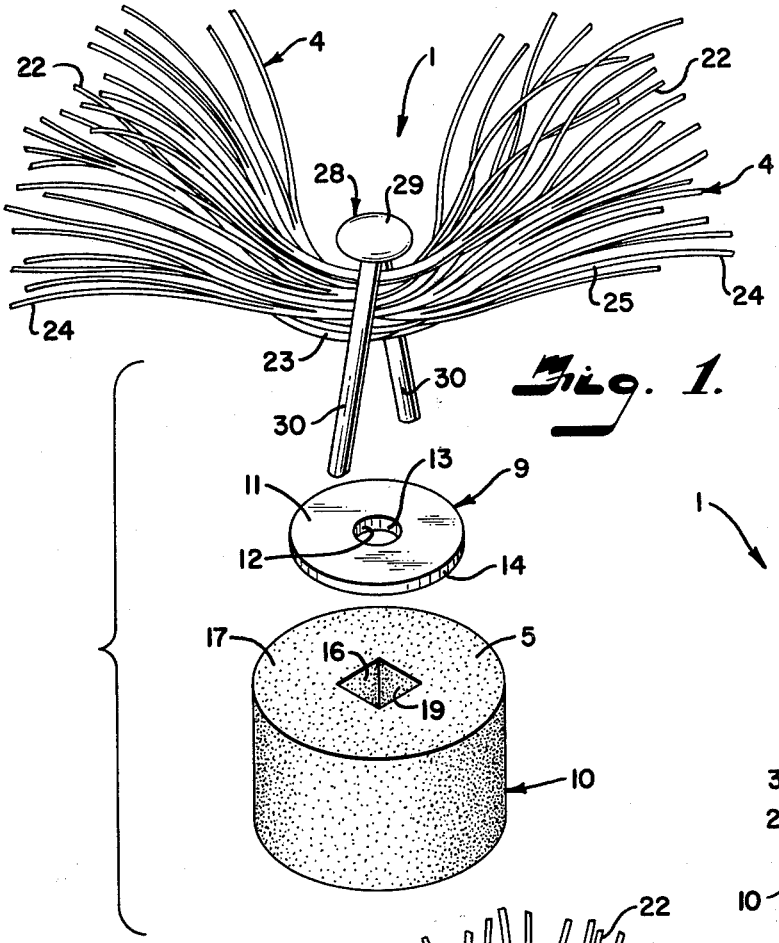
FIG. 1 is an exploded perspective view of a shuttlecock embodying the present invention.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a game device embodying the present invention and being in the nature of a shuttlecock, bird, or the like. The game device 1 comprises a weighted base 2 having one end 3 adapted for resilient impact with a shuttlecock projector (not shown), and an assemblage of lightweight filament 4 connected with the other end 5 of the base 2.

The base 2 includes a weight 9 and a soft, resilient sleeve 10 which encases the weight 9. The illustrated weight 9 has an annular shape in the nature of a washer, with substantially flat sides 11, a central aperture 12, and inner and outer circumferential edges 13 and 14 respectively. The weight is preferably constructed of a durable, relatively heavy material, such as steel, iron, aluminum, or the like. The inner and outer edges 13 and 14 are preferably smooth and free of sharp edges. The illustrated sleeve 10 has a cylindrical shape with a central aperture 16, and ends 17 and 18. The aperture 16 is defined by an interior surface 19 having a marginal dimension which is substantially less than the diameter of the outer circumferential edge 14 of the weight 9. In this example, the aperture 16 has a substantially square transverse cross-sectional shape. The sleeve 10 is preferably constructed of a soft, lightweight material, such as an expanded synthetic resinous material, foamed plastics, or the like, and is quite resilient to propel the shuttlecock in response to impact with a projector.

The illustrated sleeve is constructed of a lightweight foam material for improved flight characteristics and is soft to prevent injurious collisions with other objects such as furniture, windows, lamps and the like. The outside diameter of the sleeve 10 is preferably enlarged, being substantially larger than the outer edge 14 of the weight 9, whereby the same offers a good target for the projector to hit, is quite safe for use by children, and assists in imparting a floating motion to the shuttlecock 1. The sleeve 10 is also fairly thick as measured longitudinally between ends 17 and 18, and is substantially larger than the thickness of the weight 9.

Figure 2:
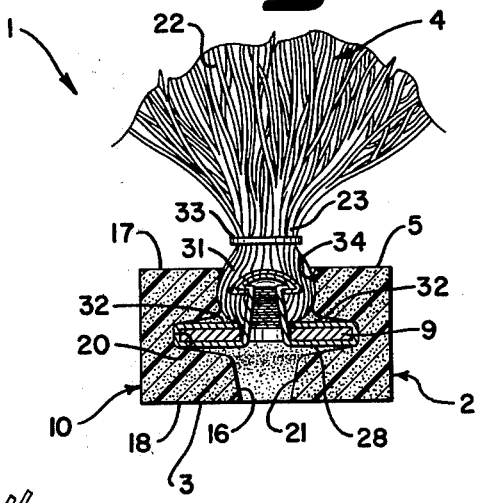
FIG. 2 is a fragmentary vertical cross-sectional view of the shuttlecock taken along an axial axis thereof.
Figure 3:
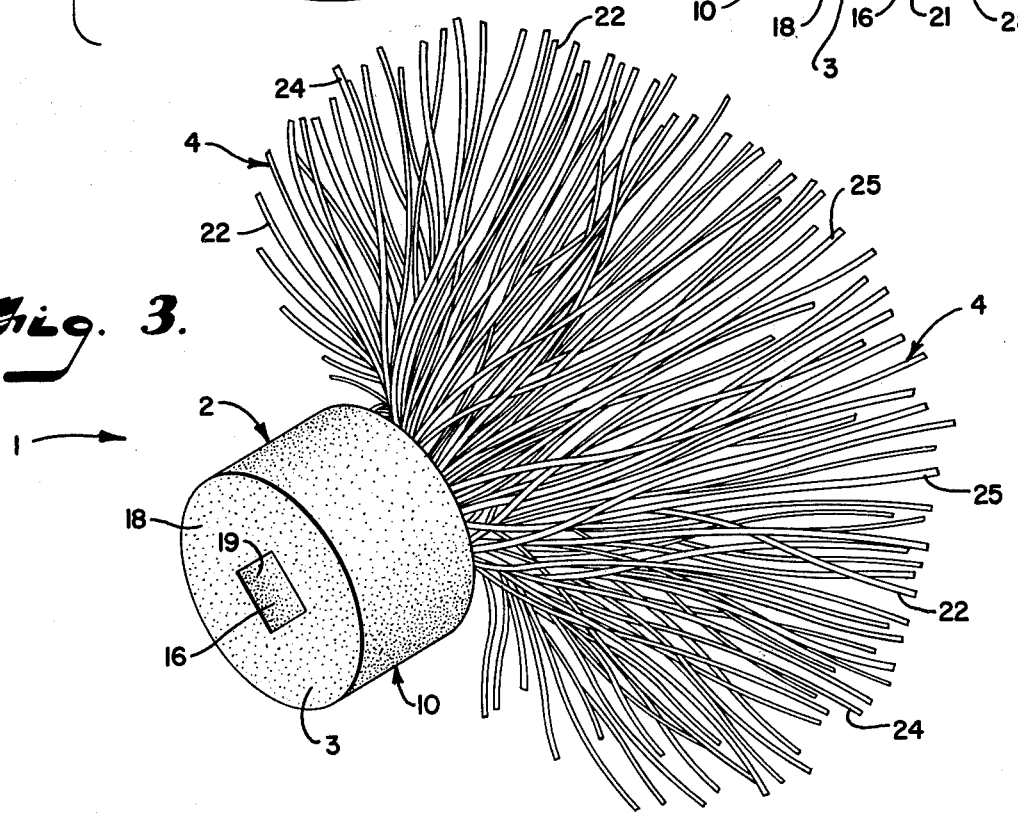
FIG. 3 is a perspective view of the shuttlecock taken from an end thereof.

The weight 9 is positioned in the sleeve aperture 16 between the ends 17 and 18 of the sleeve 10 at a medial portion of the sleeve. Because the outer edge 14 of the weight is substantially larger than the marginal dimension of the sleeve's interior surface 19, the weight 9 is securely and frictionally connected to the sleeve by the restricting, resilient forces exerted by the sleeve material. As best illustrated in FIG. 2, the sleeve aperture 16 is expanded outwardly at the medial portion 20 thereof to engage the weight 9, and the lower end 21 of the aperture extends inwardly therefrom to its unstretched state, thereby forming a square shaped aperture in the circularly shaped end 21 of the sleeve for improved elastic impact with the shuttlecock projectors.

The assemblage of lightweight filament 4 is attached to the end 5 of the weighted base 2 and imparts a floating action to the flight of the shuttlecock 1. The assemblage 4 comprises a plurality of filament strands or fibers 22, each of which is elongate and has a medial portion 23 connected with the base 2, and a pair of free ends 24 extending outwardly of the medial portion 23 of the fibers. The fibers are arranged in a fan-shaped array in the nature of synthetic "hair" or a parachute, preferably with a frustroconical or hemispherical shape, and having a woolly or flockulent appearance. The illustrated fibers 22 are flexible, but not limp, having sufficient stiffness to remain set during flight and under gravitational forces. The fibers may be constructed of a material such as jute, paper, or the like, and are preferably constructed of a shredded synthetic resin material such as polyester. The fibers 22 are formed from a shredded polyester sheet or film and have substantially flat sides 25 and are shaped like narrow ribbons. The illustrated fibers are constructed of a durable polyester, such as Dacron, which is tough to resist breakage, but is also relatively soft in the present assemblage form thereby functioning as a cushion to dampen impact with other objects and persons.

Connecting means, such as bonding, teather strings, or the like, connects the assemblage 4 with the weight 8, and in this example, a fastener 28 is provided. The fastener 28 comprises a head 29 and a pair of deformable legs 30 depending from and connecting with the head. The fastener head 29 is enlarged, having a marginal dimension greater than that of the central weight aperture 12. The medial portion 23 of the fibers is positioned between the fastener legs 30. The fastener legs 30 are threaded through the weight aperture 12 and are bent back over the outer edge 14 of the weight thereby fastening each of the fibers 22 securely to the weight. The fibers 22 are gathered at a point adjacent to the fastener head 29 and form a bulbous shaped center member 31. The end 32 of each of the illustrated legs 30 is positioned beneath the center member 31 and extends adjacent to the associated leg 30 for secure connection. The fibers 22 are retained in the gathered position by fastening means such as a clip, or illustrated resilient band 33. The central member 31 is received into the sleeve aperture 16, and in this example, the central member is somewhat larger than the end 34 of the sleeve aperture 16, and frictionally engages and slightly expands the walls thereof for a neat appearance. The illustrated fibers 22 are first gathered and connected with the base 2 and then are further shredded longitudinally of the center member 31 for a finer, softer assemblage. Hence, that portion of the fibers 22 and the central member 31 are somewhat wider than the remaining portions of the fibers.

In use, the shuttlecock 1 may be batted with a racket, paddle, or the like, or may be kicked by the user's feet or similarly struck by another portion of the user's body, such as the hands, arms, or legs. The assemblage 4 causes the shuttlecock to translate through the air end 18 first under most circumstances. The soft sleeve 9 both protects the user from injuring that portion of the body against which the shuttlecock is struck, and also provides resilient impact with the shuttlecock projector. Furthermore, the sleeve alleviates the hazard of injury to persons and/or property when it inadvertently strikes or collides with another object, and thereby renders the game device safe for use in indoor settings or other similarly confined play areas. Because the weight 8 is not fixedly attached to the sleeve 9, the user may readily adjust the amount of tip cushion he desires by simply moving the weight slightly toward or away from the leading sleeve end 18. In this manner, the toy may be adjusted with maximum cushion for use in confined areas, and minimum tip cushion for use in spacious play areas.

The assemblage 4 imparts a floating or parachuting action to the shuttlecock 1 by providing increased wind resistance. Because the assemblage is comprised of a plurality of fibers 22, the assemblage also guides the flight of the shuttlecock. Since the fibers 22 are flexible, they may be inadvertently kicked, stepped on, or similarly mistreated without injuring the game device. Also, both the base 2 and assemblage 4 are soft, presenting no sharp edges which could injure the user, and is therefore adapted to use by even small children.

Figure 4:
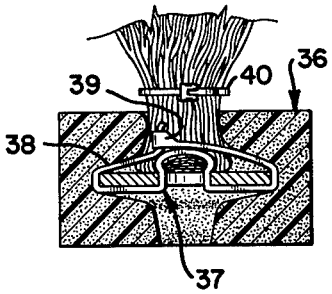
FIG. 4 is a fragmentary vertical cross-sectional view of another embodiment of the invention having a flexible tie fastener.

The reference numeral 36 generally designates a second embodiment of the present invention. As illustrated in FIG. 4, the shuttlecock 36 is quite similar to the previously described embodiment 1, and includes a flexible tie fastener 37 for securely and safely attaching the weight to the assemblage. The illustrated tie 37 is constructed of a resilient material such as nylon or the like, and has a band-like shape with one end 38 serrated, and the other end 39 comprising a mating, slotted head for engaging and retaining the serrated tie end 38 therein. A medial portion of the tie engages the upper surface of the assembled filaments, and the ends 38 and 39 are threaded through the weight aperture, bent around the peripherial end of the weight, and are interconnected over the filament upper surface. The tie 37 securely interconnects the weight and assemblage members, and is without any sharp edges which might cause injury to the user. In this example, a second tie 40, having a construction similar to the first tie 37, is disposed adjacent to the weight, and retains the filament medial portions in a gathered position in much the same manner as the resilient band 33.

It is to be understood that while I have illustrated and described certain forms of my invention, it is not to be limited to the specific forms or arrangement of parts herein described and shown.

What I claim and desire to secure by Letters Patent is:

1. In a shuttlecock having a weighted base with one end thereof shaped for resilient impact with a shuttlecock projector; said shuttlecock being adapted to be propelled through the air and to assume a path of flight wherein the one end of said base is generally oriented forwardly most in the direction of said flight; the improvement comprising:

(a) an assemblage of lightweight, non-limp filament connected with the other end of said base and imparting a floating action to the flight of said shuttlecock;

(b) a weight having a marginal edge; and (c) a sleeve being flexible and resilient, and having a central aperture extending therethrough; said weight being positioned laterally in said sleeve aperture and being axially movable between opposing ends thereof to vary the thickness of that portion of the sleeve disposed between said weight and said base one end; the marginal edge of said weight abutting an interior surface of said sleeve and frictionally retaining said weight in a selected position therein, whereby said weight is selectively, axially translated in said sleeve central aperture with respect to said base one end for adjusting shuttlecock tip cushion.

2. An article as set forth in claim 1 wherein:

(a) said assemblage comprises a plurality of fibers each having a medial portion thereof connected with said base, and a pair of free ends extending outwardly of said medial portion and forming a fan-shaped array.

3. An article as set forth in claim 1 wherein:

(a) said assemblage comprises a plurality of fibers each having a medial portion thereof connected with said base, and a pair of free ends extending outwardly of said median portion and forming a fan-shaped array;

(b) said weight has an annular shape with a central aperture, including (c) fastening means having an enlarged head and a pair of deformable legs depending from and connected with said head;

(d) said medial portion of each of said fibers being positioned between said legs; and (e) said legs being threaded through the central aperture of said weight and being bent back over the marginal edge of said weight thereby fastening each of said fibers to said weight.

4. An article as set forth in claim 1 wherein:

(a) said sleeve is constructed of an expanded synthetic resinous material.

* * * * *